US006533130B1

(12) United States Patent
Padiak et al.

(10) Patent No.: US 6,533,130 B1
(45) Date of Patent: Mar. 18, 2003

(54) ILLUMINATED CHIP RACK

(75) Inventors: Scott Padiak, Winnetka, IL (US); Thomas M. Conway, Chicago, IL (US)

(73) Assignee: Cormark, Inc., Elk Grove Village, IL (US)

( * ) Notice: Subject to any disclaimer, the term of this patent is extended or adjusted under 35 U.S.C. 154(b) by 0 days.

(21) Appl. No.: 10/044,435

(22) Filed: Jan. 11, 2002

(51) Int. Cl.[7] ..... A47F 5/00

(52) U.S. Cl. ..... 211/50; 211/55; 211/128.1; 40/124.2; 362/125; 362/127; 362/133

(58) Field of Search ..... 211/55, 128.1, 211/50; 40/124.2, 124.02; 362/576, 551, 125, 133, 127

(56) References Cited

U.S. PATENT DOCUMENTS 3,838,266 A * 9/1974 Jonathan ..... 40/124.2 X
4,003,470 A * 1/1977 Lagorio et al. ..... 40/124.2 X
4,102,072 A * 7/1978 Buschman ..... 40/124.2
4,689,726 A * 8/1987 Kretzschmar ..... 362/127
5,029,715 A * 7/1991 Strada ..... 211/55
5,031,781 A * 7/1991 Price et al. ..... 211/55 X
5,034,861 A * 7/1991 Sklenak et al.
5,205,638 A * 4/1993 Squitieri ..... 362/125
5,620,103 A * 4/1997 Vlah et al. ..... 211/55
6,275,644 B1 * 8/2001 Domas et al.
6,283,608 B1 * 9/2001 Straat ..... 362/133

* cited by examiner

*Primary Examiner*—Robert W. Gibson, Jr.
(74) *Attorney, Agent, or Firm*—Welsh & Katz, Ltd.

(57) ABSTRACT

A display rack for displaying displayed items can be an opaque cabinet with a light source located in the opaque cabinet. The cabinet has a transparent light pipe having a light accepting end and a light emitting end, connected by a light conducting body having an index of refraction that transmits light from the light accepting end to the light emitting end. The cabinet has at least a first tray having an item display portion for holding the displayed item and a second tray having an opaque bottom wall and an opaque front portion configured to operably connect the light accepting end of the transparent light pipe to the light source and maintains the light emitting end of the light pipe in a position where the light emitted by the light emitting end illuminates the card holding portion of the first tray.

16 Claims, 4 Drawing Sheets

ILLUMINATED CHIP RACK

BACKGROUND OF THE INVENTION

The field of the invention is illuminated commercial display devices. In particular, the invention relates to a device for the display of point of purchase objects in need of illumination, such as paint chips.

The display of stacks of cards can aid a wide variety of commercial endeavors, One example is the display and dispensation of paint chips in home decorating or home improvement stores. In order to achieve the most favorable presentation of the displayed cards, the proper lighting of the cards as part of the display is desirable. Often, in a commercial environment, achieving proper lighting of displayed samples can be difficult for a variety of reasons. For example a customer standing in front of one display or travelling within an establishment could block the light of another customer. Also, the levels of lighting available from nearby windows can change throughout the day. Further, if a customer desires to inspect an object closely, the customer himself might block light from reaching the object of interest.

For a display that can display a plurality of samples, a respective plurality of light sources can be used. However, light sources generally have limited amounts of time that they can be used before replacement is needed. In the case of displays where numerous small samples are being displayed, it can be time consuming to check and replace a large number of light sources such as bulbs or tubes. Further, the failure of a single small light element may not be readily apparent from a distance by busy salespeople or other employees responsible for maintaining the display. Also, if reconfiguration of the light source for a display having multiple light sources is desired to adjust the quantity or quality of the light produced by the light source, numerous replacements are also necessary.

Accordingly, it is desirable to have a display rack that provides the ability to control the quality and quantity of light used to display a plurality of samples. Desirably, such a display rack would have lighting elements that would be easy to maintain and replace.

BRIEF SUMMARY OF THE INVENTION

One embodiment of the present invention is a display rack for displaying a displayed item having an opaque cabinet, a light source located in the opaque cabinet; and a transparent light pipe having a light accepting end and a light emitting end, connected by a light conducting body having an index of refraction that transmits light from the light accepting end to the light emitting end. A first tray has an item display portion for holding the displayed item, while a second tray has an opaque bottom wall and an opaque front portion configured to operably connect the light accepting end of the transparent light pipe to the light source and to maintain the light emitting end of the light pipe in a position where the light emitted by the light emitting end illuminates the card holding portion of the first tray.

In another embodiment of the present invention, the light source is a fluorescent bulb.

In yet another embodiment of the present invention, the light pipe is a rectangular block of polycarbonate plastic.

In still another embodiment of the present invention, the light pipe further comprises a reflector on the light emitting end of the light pipe.

In still another embodiment of the present invention, the light emitting end refracts light onto the item display portion of the first tray.

In a still further embodiment of the present invention, the second tray is shingled over the first tray.

In yet another embodiment of the present invention, the bottom wall further comprises a stop that in cooperation with the bottom wall forms a ledge.

In another embodiment, the display rack comprises a generally opaque cabinet defining a light cavity. A light providing element is located in the light cavity, and a transparent light conducting member has a light accepting end and a light emitting end that can accept light at the light accepting end, and emit the accepted light at the light emitting end. The display rack also has a first tray having a card holding portion and a second tray having an opaque light pipe supporting wall portion. The tray includes an opaque front frame portion, and maintains the transparent light pipe such that the light accepting end accepts light from the light providing element and the light emitting end of the light pipe emits light to illuminate the card holding portion the first tray.

In a still further embodiment of the present invention, the rack includes a plurality of second trays and a respective plurality of light conducting members, and the light source is an elongated light bulb, such as a fluorescent bulb, that provides light for the light conducting members of the respective trays.

In yet another embodiment of the present invention, the light pipe is a light conducting body having top and bottom surfaces and the light conducting body has an index of refraction of greater than one.

In a further embodiment, the light pipe is configured to reflect light from the light emitting end onto the card holding portion.

In still another embodiment, the light pipe is configured to refract light from the light emitting end onto the card holding portion.

In a still further embodiment, a display rack for displaying a displayed item comprises an opaque cabinet, a fluorescent light source concealed from external viewing in the opaque cabinet, and a plurality of trays. Each of the plurality of trays has an item display portion for holding the displayed item and a rectangular block of polycarbonate plastic having a light accepting end and a light emitting end, connected by a light conducting body having an index of refraction of greater than one that transmits light from the light accepting end to the light emitting end via internal reflection. Each of the trays has an opaque bottom wall and an opaque front portion configured to operably connect the light accepting end of the transparent light pipe to the light source and maintains the light emitting end of the light pipe in a position where the light emitted by the light emitting end illuminates the card holding portion of an adjacent tray, wherein the plurality of trays are arranged in a shingled arrangement.

BRIEF DESCRIPTION OF THE DRAWINGS

The benefits and advantages of the present invention will become more readily apparent to those of ordinary skill in the relevant art after reviewing the following detailed description and accompany drawings, wherein.

DETAILED DESCRIPTION OF THE INVENTION

Figure 1:
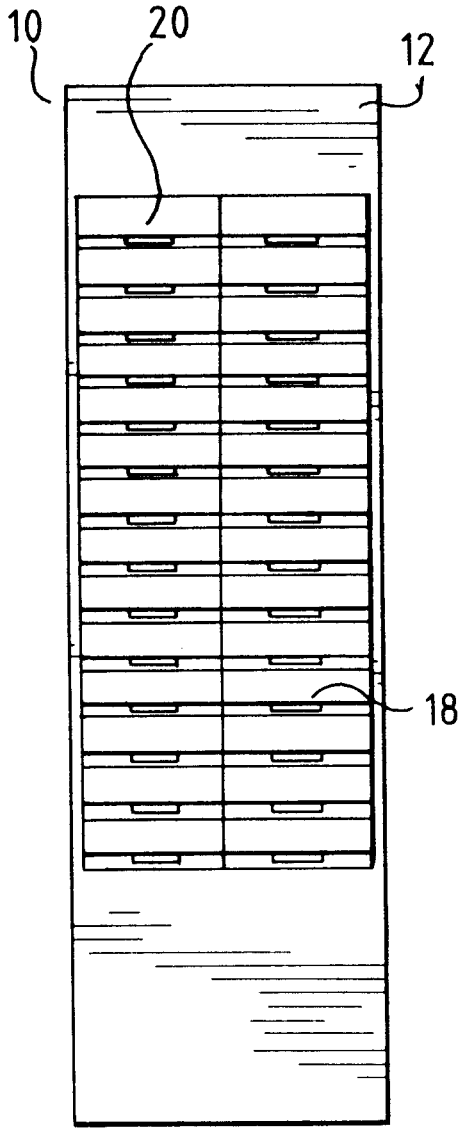
FIG. 1 is a front view of an exemplary display rack of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

It is to be further understood that the title of this section of the specification, namely, "detailed Description of the Invention" relates to a requirement of the United States Patent and Trademark Office, and is not intended to, does not imply, nor should be inferred to limit the subject matter disclosed herein or the scope of the invention.

Figure 2:
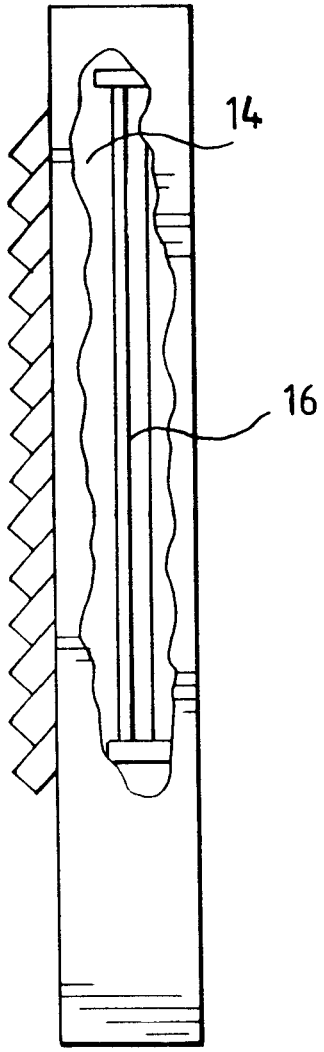
FIG. 2 is a side view of an exemplary display rack of the present invention.
Figure 3:
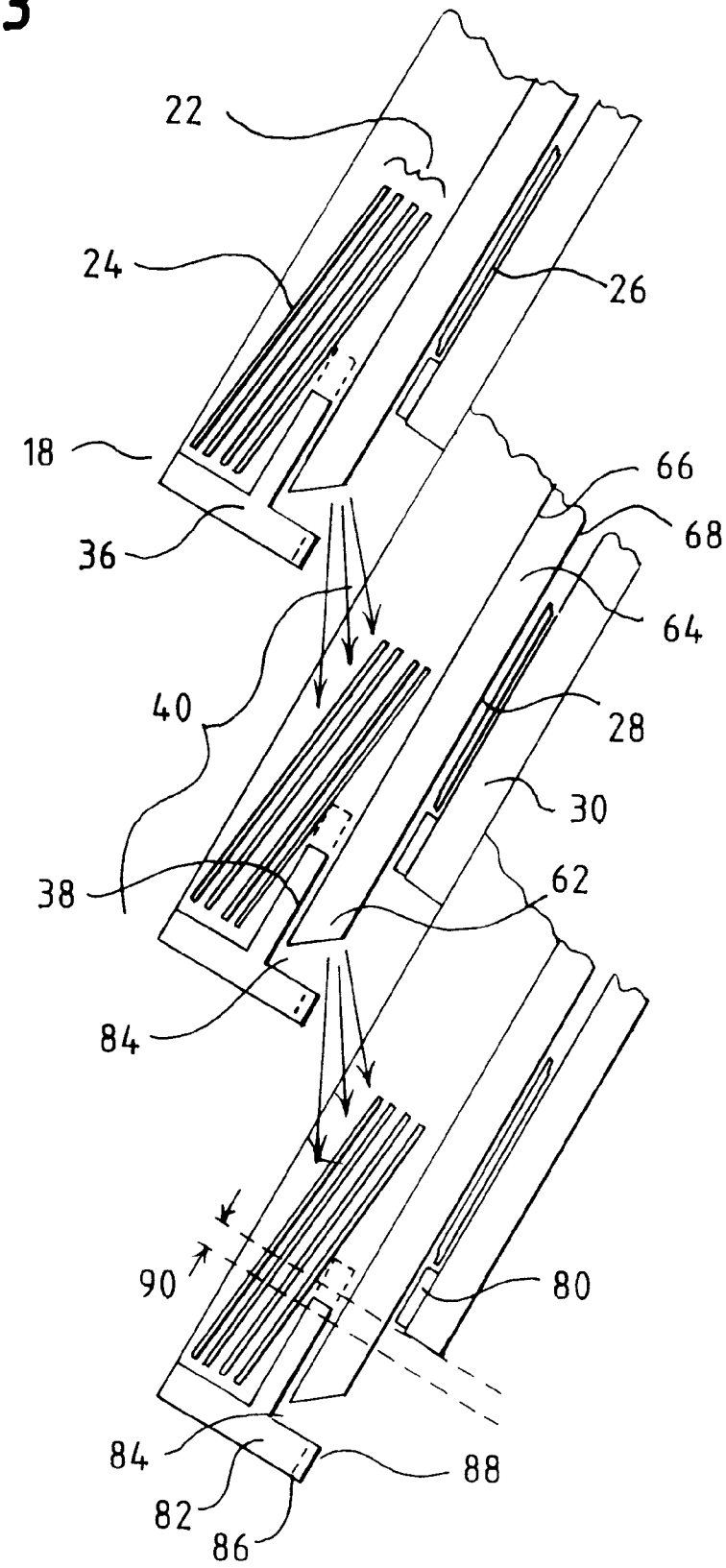
FIG. 3 is a cross-sectional view depicting the construction of the trays of an exemplary display rack of the present invention.
Figure 4A:
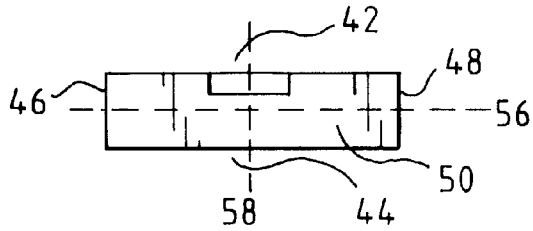
FIGS. 4A–C are front, top, and back views of a single tray of an exemplary display rack of the present invention.
Figure 4B:
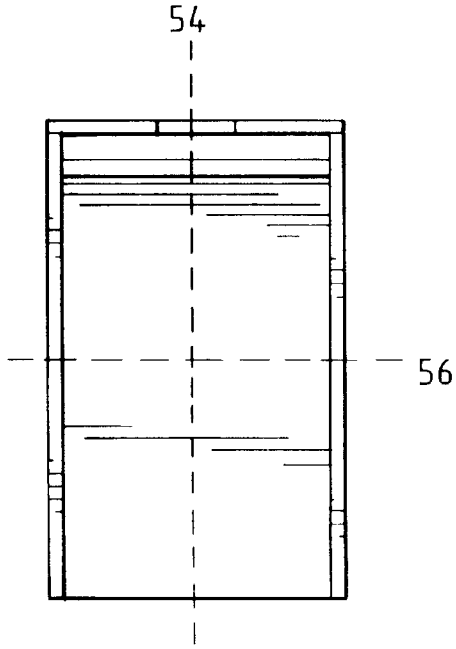
Figure 4C:
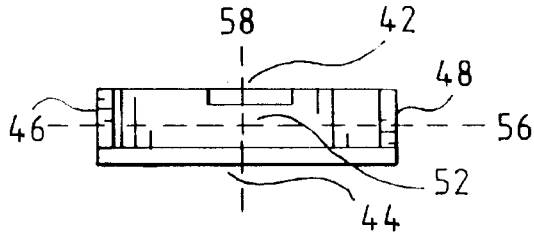

Referring to the figures, and in particular, FIGS. 1–2, there is illustrated a display rack 10 constructed in accordance with the present invention. Typically such display racks 10 are placed in a retail establishment dealing in paints including hardware stores, home decorating stores, and paint stores. A display rack 10 of the present invention comprises a cabinet 12 having an interior cavity 14, a light source 16 in the cavity, and a plurality of display trays 18. The plurality of display trays 18 are arranged in a shingled fashion in two side-by-side columns 20. Each of the plurality of display trays 18 can store and display respective pluralities of stacks 22 of cards 24 (See. FIG. 3).

The cards 24 displayed can be any type of card, but in the exemplary embodiment(s) contained herein, the display 10 is used for displaying "paint chip cards" such as are commercially displayed to demonstrate the variety of colors that paints are available in from a retail seller of paint. As will be understood by those of ordinary skill in the art, displayed cards 10 can be any size and shape. Generally, paint chip cards are available in a rectangular format that can have one or more colors present on a single paint chip card. However, the present display rack 10 can be used for cards 24 having single or multiple colors or fields present.

Continuing with FIG. 3, the display rack 10 can be configured to provide illumination for stacks 22 of free cards 24 and support the stacks in an arrangement that facilitates the viewing and removal of the cards by consumers. Optionally, as also displayed in FIG. 3, the display rack 10 can also be configured to trap a single (or trapped) card 26 underneath a transparent body (such as the light pipe 28) so that even when the all of the cards in the stack are removed, an indicator of what cards are supposed to be restocked is present. In the illustrated embodiments, the display rack 10 is constructed to display and hold both trapped 26 and free 24 cards.

Trays 18 are configured to display both trapped cards 26 and free cards 24 in accordance with a display rack 10 of the present invention, and are illustrated in FIGS. 3 and 4A–C. The tray 18 can have a bottom wall 30, two side walls 32, 34, a front wall 36, a light-blocking divider 38, and a light pipe 28. For the purpose of this disclosure, each tray 18 and its associated parts can be understood as having a top 42, bottom 44, left and right side 46, 48, front 50, and back 52 regions. A first (length) axis 54 of a tray 18 runs from the back 52 to the front 50, a second (width) axis 56 runs between the left and right sides 46, 48 of the tray, and a third (height) axis 58 runs from the top 42 to the bottom 44.

Returning to FIG. 3, the display rack 10 comprises trays 18 that are arranged in shingled relationship to each other, with each tray 18 partially overlaying and being shifted in relation to the trays 18 above and below it. The shingling exposes an item display portion 40, which in the case of the preferred embodiment is a card dispensing portion, of each tray 18.

The shingling or staggering of the trays 30 permits the trays to hold and display at least one trapped card 26, and a plurality of free (or movable or loose) cards 24. The trays 30 are configured so that the free cards 24 can be removed from the top 42 of the tray 30, in a generally upward and outward direction from the display rack 10. The shingling or staggering of the trays 30 also permits the light pipe 40 of one tray 30 to illuminate the cards 24, 26 present in an adjacent lower tray.

The light pipe 28 is a generally transparent structure that conducts light from a light accepting end 60 to a light emitting end 62 via a light conducting body 64. The light accepting end 60 of the light pipe is positioned at the back 52 of the tray 18, and the light emitting end 62 of the light pipe 28 is positioned towards the front 50 of the tray 18. The light conducting body 64 can have top 66 and bottom 68 surfaces. The light conducting body 64 can be made from a transparent material, such as a polycarbonate plastic sold under the brand-name LEXAN®.

The light pipe 28 can conduct light from the light source 16 by internally reflecting visible light originating at the light source. Such internal reflection can be achieved when the light that is being transmitted through the light conducting body 64 is reflected back into the body when the light encounters a surface 66, 68 of the light conducting body 64. Such principles of total internal reflection are well known and easily accessible to those of ordinary skill in the art. See e.g. Richard P. Feynman, Robert B. Leighton, Matthew Sands, *The Feynman Lectures On Physics* II-33-12 (Addison-Wesley Publishing Co. 1964). Thus, when the light accepting end 60 is exposed to light, the light can be conducted or transmitted to the light emitting end 62 of the light pipe 28, and leave the light pipe at the light emitting end.

In the illustrated embodiment, the light pipe 28 is a generally rectangular block of a transparent material having an index of refraction of greater than one. The light pipe 28 can be made of various glasses, plastics, or other transparent materials. The light pipe 28 can be made of a single material or can be made of a plurality of materials. For example, the light pipe 28 can have a core material sheathed in a coating material in a fashion analogous to an optical fiber.

The light pipe 28 can have an index of refraction substantially higher than one such as an index of refraction similar to that used for eyeglass materials (greater than 1.4). Some materials having such high indices of refraction are made from polycarbonate resins (e.g. LEXAN®). Other embodiments can use materials suitable for optical lenses having an index of refraction greater than 1.5. Further, in some embodiments of the present invention, the light pipe 28 is made of a material having low chromatic dispersion (separation of light into different colors) so that different colors of light are not separated thus creating rainbow-like effects on illuminated surfaces, cards, or chips.

Shapes other than rectangular blocks that enable light to traverse the structure of the light pipe 28, such as trapezoidal shapes, series of parallel rods that can be spaced apart or fused, and the like can be used. Those of ordinary skill will recognize that other shales can be made to conduct light from one place to another using a transparent body of one or more elements, and such shapes and their equivalents are contemplated by the present invention.

The light accepting end 60 is a non-reflective surface that is generally perpendicular to the direction that the light travels in, and permits light to enter the light pipe 28. The light emitting end 62 of the light pipe 28 directs the light emitted by the light pipe toward the dispensing portion 40 of adjacent tray 18. Preferably, the light is directed downwardly. Such a configuration allows an upper, first tray 18 to illuminate the contents of a lower, second tray 18.

Figure 5A:
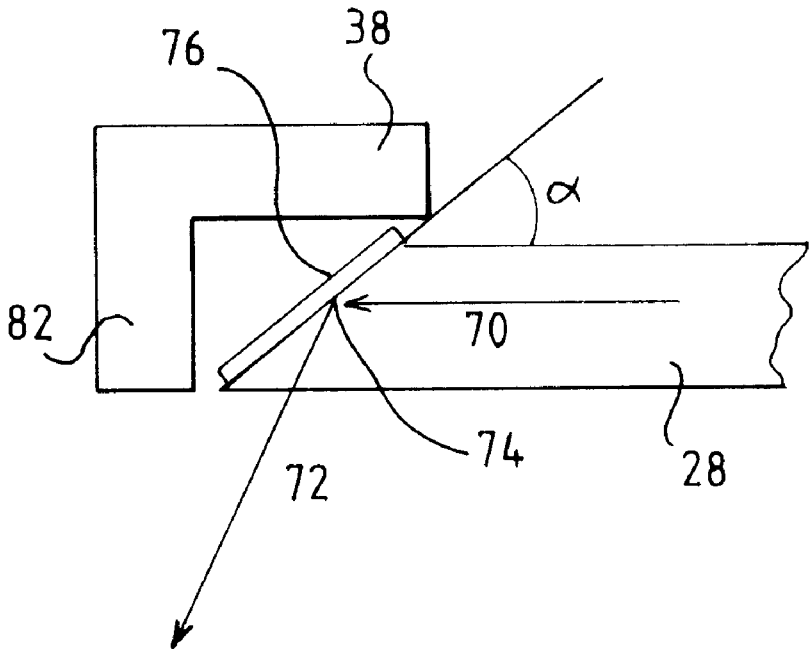
FIGS. 5A–B are diagrams of reflection and refraction configuration of the light emitting end of the light pipe.

The light emitting end 62 of the light pipe 28 can be implemented by reflective optics, refractive optics or combinations thereof In one embodiment, shown in FIG. 5A, the light-emitting end 62 is configured to use reflection to turn a conducted beam 70 of light into a reflected beam 72 of light so as to illuminate the adjacent tray 18. The illustrated light pipe 28 has a emitter surface 74 that is generally slanted with respect to the light conducting body 64. The angle of slant, $\alpha$; can be about 5°–85°, and is preferably 30°–60°, with a slant of 40°–50° being most preferred. The light-emitting end 60 can further comprise an optional reflector 76. The reflector 76 can be applied to the light pipe 28 as a reflective paint or other liquid mixture, or can be a solid reflective material, such as a mirror, fixed to the light-emitting end 62 of the light pipe 28 with an adhesive.

Figure 5B:
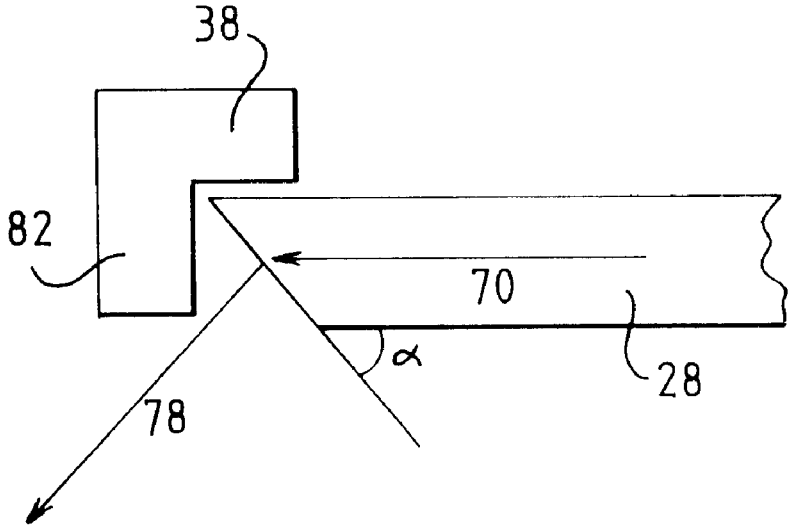

In another embodiment, shown in FIG. 5B, the light-emitting end 62 is configured to use refraction to direct the conducted beam 70 of light into a refracted beam 78 of light so as to illuminate the adjacent tray 18. The illustrated light pipe 28 has an emitter surface 74 that is generally slanted with respect to the light conducting body 64. The angle of slant, $\alpha$, can be about 5°–85°, and is preferably 30°–60°, with a slant of 40–50° being most preferred.

Each tray can comprise a light pipe 28, a bottom wall 30, one or more side walls 32, 34, a front wall 36, and a light blocking divider 38. The bottom wall 30, side walls 32, 34, front wall 36, and divider 38 can be can be made of solid materials capable of supporting the light pipe 28 and the displayed cards 24, 26. Examples of suitable material include, but are not limited to, wood, solid plastic, and plastic foam. The tray 18 is oriented to hold cards 24, 26 such as paint chip cards, disposed in a generally upward and outward direction from the display rack 10.

Again referring to FIG. 4, the bottom wall 30 of the tray 18 can be a generally rectangular opaque structure. However, other shapes are possible such as a polygonal cabinet wherein the bottom panels 30 are trapezoidal. Numerous shapes that trays can be made of are apparent to those of ordinary skill in the art and are contemplated by the present invention.

Returning to FIG. 3, the bottom wall 30 can support the cards 24, 26 and the light pipe 28, and thereby comprise a supporting wall. Further, the bottom wall 30 is opaque and prevents objects below the bottom wall from being viewed. The bottom wall 30 also provides a background against which a trapped chip 26 can be viewed. Preferably, the bottom wall 30 is white in color to provide a neutral background against which paint chips can be viewed.

Optionally, the bottom wall 30 can have a stop 80 (or rib, or other retaining structure) to maintain a trapped chip 26 between the light pipe 28 and the bottom wall 30. The stop 80 can be attached to the bottom wall 30, such as with an adhesive or a fixture, or can be formed integral with the wall 30. The illustrated stop 80 of FIG. 3, is a rectangular strip that is adhered to the bottom wall 30 with an adhesive. The stop 80 can be made from the same material as the bottom wall 30 or a different material. The stop 80 can also be the same color as or a different color from the bottom wall.

As those of ordinary skill in the art will appreciate, a stop 80 that can maintain a trapped chip 26 between the light pipe 28 and the bottom wall 30 can be shaped or formed in a variety of configurations. For example, the stop 80 can extend across the full width of the bottom wall 30, or can extend across only a portion of the bottom wall. The stop 80 can be formed from one or more spaced apart portions or segments with spacings in between. Thus, as those of ordinary skill will appreciate, the stop 80 can be a plurality of posts spaced across the entire width, or can be a continuous rectangular stop. All such variations of the stop 80 and their equivalents are contemplated by the present invention.

The stop 80 can extend transversely to the bottom wall 30 to form a ledge to hold the trapped card 26, supporting the card 26 from sliding between the light pipe 28 and the bottom wall 30. In the illustrated embodiment, the transversely oriented stop 28 is directed upwardly from the bottom wall 30. Absent the stop 80, the light pipe 28, the bottom wall 30, or both can be configured to frictionally hold the trapped card 26 in place. Alternatively, the trapped caged 26 can be held by glue, paste, adhesive, nail, or other means known to those of ordinary skill.

The tray 18 also has a framing portion 82 configured to maintain the light pipe 28 in the tray 18 and obscure the direct visibility of light from the light-emitting end 62 of the light pipe 28. The frame portion 82 is made of an opaque material that prevents light from the light-emitting end 62 of the light pipe 28 from passing through the frame portion.

The frame portion 82 can be an L-shaped member positioned in front of and on top of the light pipe 28. The frame portion 82 has at least one interior surface 84. Preferably, the interior surface 84 reflects light. The interior surface 84 can be made to reflect light by configuring the interior surface of the frame portion 82 to have a mirrored surface, metallic surface, white surface, or other quality that will allow light exiting the light pipe 28 to be directed away from the frame portion in a downward direction.

The frame portion 82 has a stop portion 86 that is located adjacent to the light-emitting end 62 of the light pipe 28. The illustrated stop portion 86 has a bottom end 88. The bottom end 88 of the stop portion 86 can extend below the bottom surface 68 of the light pipe 28, or, as illustrated with the dotted line 90, can be level with the bottom 68 of the light pipe 28. When the stop portion 86 of the frame portion 82 extends below the bottom 68 of the light pipe 28, the stop portion can prevent a trapped card 26 from slipping out of the tray 18.

The stop portion 86 is configured to confront the light emitting end 62 of the light pipe 28 and limit the travel of the light pipe 28 relative to the bottom wall 30. When the light pipe 28 is supported by the bottom wall 30 and the tray 28 is tilted, gravitational forces will tend to apply a force that directs the light pipe 28 toward the stop portion 86 of the frame portion 82.

The frame portion 82 also has a light-blocking divider 38 that is generally parallel to and adjacent to the top surface 66 of the light pipe 28 near the light-emitting end 62. The light blocking divider 38 can contact the light pipe 28 or can be spaced above the light pipe. The light blocking divider 38 can prevent light emitted by the light emitting end from traveling in an upward direction. As illustrated in FIG. 3, a spacing 90 can separate the bottom wall 30 and the light blocking divider 38 along the length axis 54 of the tray 18. Such a spacing 90 can permit a viewing window through the tray 18. Alternatively, the light blocking divider 38 can spacedly overlie the bottom wall 30. In such a configuration, the light-blocking divider 38 and bottom wall 30 cooperate to more completely block viewing through the tray 18.

The light blocking divider 38 of the frame portion 82 can serve as a card retaining member. When the light blocking divider 38 has a height sufficient to support a plurality of cards 24, the light blocking divider 38 can support the cards 24 so that they do not fall from the display rack 10. Alternatively, the front 50 of the tray can further comprise a vertical front wall 36 that rises above the light blocking divider 38 to provide a structure to maintain a plurality of displayed cards 24 in a position where they can be easily viewed and dispensed.

The tray 18 can have one or more side walls 32, 24. The side walls 32, 34 are oriented transversely to the bottom wall 30 and the frame portion 82 and can perpendicular to the bottom. The side walls 32, 34, like the bottom wall 30 and the frame portion 82 are opaque.

A display rack 10 of the present invention comprises a generally opaque cabinet 12. The cabinet 12 can be made of natural materials, such as wood, or artificial materials such as plastic, or sheet metal. Preferably, a lightweight material such as plastic foam sheets are sued. The illustrated cabinet 12 has a generally rectangular horizontal cross-section, but the horizontal cross-section of the cabinet can be any shape including, but not limited to, regular polygons, irregular polygons, round, oval, and other regular and irregular actuate shapes.

It is preferred that the cabinet 12 resist being easily tipped. One structure for resisting tipping is to place a weight in the bottom end of the cabinet 12. Another structure to resist tipping is to include a base that is relatively wider than the cabinet 12 on the bottom. Another structure that aids in resisting tipping is to have fasteners or adhesives hold the cabinet 12 to an adjacent stable surface or object such as a wall, ceiling, floor, post or equivalents therof.

The cabinet 12 defines an interior space or cavity 14. In order to minimize the quantity of light needed to operate the display rack 10, it is preferred that the interior surfaces of the cavity 14 reflect light rather than absorb it. Painting the interior of the cabinet white, or using shiny metallic linings or paints can decrease light absorption in the cabinet, thereby allowing more light to exit through the light pipes. However, any such interior 14 finish must take into consideration the nature of the items being displayed. Where, for example, the display is fog use with paint chips, the interior 14 finish should be sufficiently neutral so as to not affect the "coloring" of the paint chips.

Referring back to FIG. 2, a light source 16 is located inside the cavity 14. The light source 16 can be of any type that can be contained in the cabinet 12. Common light sources 16 include, but are not limited to, fluorescent bulbs, standard incandescent bulbs, halogen bulbs, and the like. The cabinet 12 can have multiple light sources installed therein. The light cabinet can also have a control to adjust the level of output of the light source. The light source 16 provides the light that enters the light accepting end.60 of the light pipe 28. Again, the type of light source 16 should be considered in view of the displayed items.

In one embodiment of the present invention, the light source 16 is a pair of fluorescent bulbs. The bulbs are vertically oriented behind each of two respective columns 20 of shingled trats 18. The bulbs are at least as long as the columns 20 of trays 18 so that each light pipe 18 is adjacent to a fluorescent bulb.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

We claim:

1. A display rack for displaying at least two associated displayed items comprising:

an opaque cabinet;

a light source located in the opaque cabinet;

a transparent light pipe having a light accepting end and a light emitting end, connected by a light conducting body having an index of refraction that transmits light from the light accepting end to the light emitting end;

a first tray having an item display portion for holding one of the displayed items;

a second tray having an opaque bottom wall and an opaque front portion configured to operably connect the light accepting end of the transparent light pipe to the light source and maintain the light emitting end of the light pipe in a position where light emitted by the light emitting end illuminates the item display portion of the first tray, the second tray further being configured to hold another of the displayed items.

2. The display rack of claim 1, wherein the light source is a fluorescent bulb.

3. The display rack of claim 1, wherein the light pipe is a rectangular block of polycarbonate plastic.

4. The display rack of claim 1, wherein the light pipe further comprises a reflector on the light emitting end of the light pipe.

5. The display rack of claim 1, wherein the light emitting end refracts light onto the item display portion of the first tray.

6. The display rack of claim 1, wherein the second tray is shingled over the first tray.

7. The display rack of claim 1, wherein the bottom wall further comprises a stop that in cooperation with the bottom wall forms a ledge.

8. The display rack of claim 1, including a plurality of shingled trays.

9. A display rack comprising:

a generally opaque cabinet defining a light cavity;

a light providing element located in the light cavity;

a transparent light conducting member having a light accepting end and a light emitting end that can accept light at the light accepting end, and emit the accepted light at the light emitting end;

a first tray having a card holding portion;

a second tray having an opaque light conducting member supporting wall portion and an opaque front frame portion, the tray maintaining the transparent light conducting member such that the light accepting end accepts light from -the light providing element and the light emitting end of the light conducting member emits light to illuminate the card holding portion of the first tray.

10. The display rack of claim 9, comprising a plurality of second trays and a respective plurality of light conducting members wherein the light source is an elongated light bulb that provides light for the light conducting members of the respective trays, each of the second trays including a card holding portion.

11. The display rack of claim 9, wherein the light conducting member is a light conducting body having top and bottom surfaces wherein the light conducting body has an index of refraction of greater than one.

12. The display rack of claim 9, wherein the light conducting member is configured to reflect light from the light emitting end onto the card holding portion.

13. The display rack of claim 9, wherein the light conducting member is configured to refracts light from the light emitting end onto the card holding portion.

14. The display rack of claim 9, wherein the second tray is shingled over the first tray.

15. The display rack of claim 9, wherein the bottom wall further comprises a stop that is configured to maintain a trapped chip in position.

16. A display rack for displaying displayed item composing:

an opaque cabinet;

a fluorescent light source concealed from external viewing in the opaque cabinet;

a plurality of trays each tray having a item display portion for holding the displayed item and having a rectangular block of polycarbonate plastic having a light accepting end and a light emitting end, connected by a light conducting body having an index of refraction of greater than one that transmits light from the light accepting end to the light emitting end, wherein each of the trays has an opaque bottom wall and an opaque front portion configured to operably connect the light accepting end of the rectangular block to the light source and maintain the light emitting end of the rectangular block in a position where the light emitted by the light emitting end illuminates the card holding portion of an adjacent tray, wherein the plurality of trays are arranged in a shingled arrangement.

* * * * *